US011772105B2

(12) United States Patent
Müller et al.

(10) Patent No.: US 11,772,105 B2
(45) Date of Patent: Oct. 3, 2023

(54) SPRAY ATTACHMENT FOR BRINGING OUT FLUID SUBSTANCES IN A JET-LIKE MANNER

(71) Applicant: ALPLA Werke Alwin Lehner GmbH & Co. KG, Hard (AT)

(72) Inventors: Florian Müller, Hard (AT); Klemens Bösch, Lustenau (AT)

(73) Assignee: ALPLA WERKE ALWIN LEHNER GMBH & CO. KG, Hard (AT)

( * ) Notice: Subject to any disclaimer, the term of this patent is extended or adjusted under 35 U.S.C. 154(b) by 359 days.

(21) Appl. No.: 17/099,940

(22) Filed: Nov. 17, 2020

(65) Prior Publication Data

US 2021/0069734 A1 Mar. 11, 2021

Related U.S. Application Data

(63) Continuation of application No. PCT/EP2019/057503, filed on Mar. 26, 2019.

(30) Foreign Application Priority Data

May 17, 2018 (CH) ..... 00617/18

(51) Int. Cl.
*B05B 1/10* (2006.01)
*B05B 15/65* (2018.01)
*B65D 83/00* (2006.01)

(52) U.S. Cl.
CPC ..... *B05B 1/10* (2013.01); *B05B 15/65* (2018.02); *B65D 83/0055* (2013.01)

(58) Field of Classification Search
CPC ..... B05B 1/10; B05B 15/65; B65D 83/0055
(Continued)

(56) References Cited

U.S. PATENT DOCUMENTS 3,321,114 A 5/1967 Croyle
4,141,475 A * 2/1979 Nilson ..... B65D 47/2081 222/494

(Continued)

FOREIGN PATENT DOCUMENTS

EP 2881334 A1 6/2015
WO 9964311 A1 12/1999
WO 2017125595 A1 7/2017

OTHER PUBLICATIONS

Office Action (Examination Report) dated Aug. 9, 2021, by the Patent Office, Government of India, in corresponding India Patent Application No. 202017048807 with an English Translation of the Office Action. (6 pages).

(Continued)

*Primary Examiner* — Steven J Ganey
(74) *Attorney, Agent, or Firm* — BUCHANAN INGERSOLL & ROONEY PC

(57) ABSTRACT

A spray attachment for bringing out fluid substances in the manner of a jet includes a cap with an annularly peripheral, closed skirt with a wall, on whose inner side or outer side first fastener is integrally formed. The first fastener can engage a corresponding second fastener of an outer wall or inner wall of a container neck. The skirt at a longitudinal end is closed off by a cover surface having a recess. A receiving part for receiving an insert part is arranged in the region of the recess, and includes a conical receiving surface for receiving a conical peripheral surface of the insert part. The conical receiving service and the conical peripheral surface delimit at least one through-channel for fluid substance, through which the fluid substance can be brought out.

22 Claims, 5 Drawing Sheets

(58) Field of Classification Search
USPC ..... 239/327, 461; 222/107, 494, 499
See application file for complete search history.

(56) References Cited

U.S. PATENT DOCUMENTS

| | | | | |
|---|---|---|---|---|
| 4,699,300 | A * | 10/1987 | Blake | B65D 47/2081 222/494 |
| 7,740,155 | B1 * | 6/2010 | Gallegos | B65D 35/36 222/494 |
| 2015/0273504 | A1 | 10/2015 | Bloc | |
| 2017/0080442 | A1 | 3/2017 | Carraro et al. | |
| 2019/0023463 | A1 | 1/2019 | Knight | |

OTHER PUBLICATIONS

International Search Report (PCT/ISA/210) dated Jun. 26, 2019, by the European Patent Office as the International Searching Authority for International Application No. PCT/EP2019/057503.
Written Opinion (PCT/ISA/237) dated Jun. 26, 2019, by the European Patent Office as the International Searching Authority for International Application No. PCT/EP2019/057503.

* cited by examiner

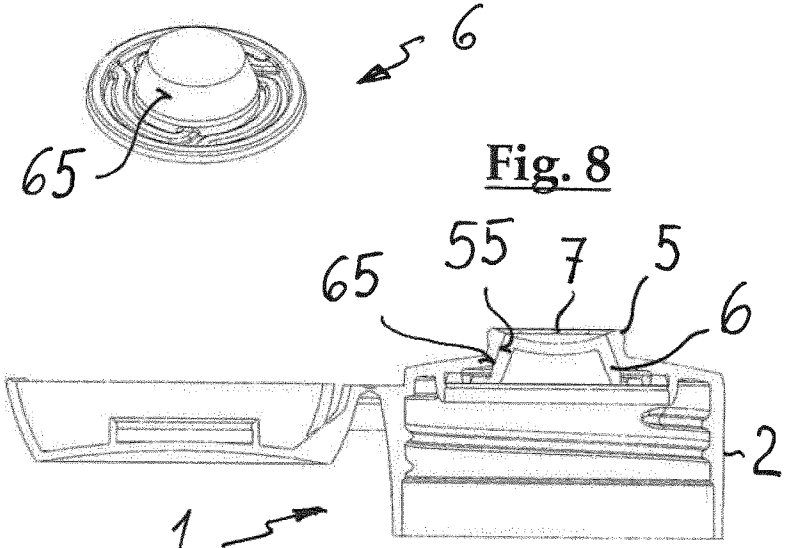
Fig. 8
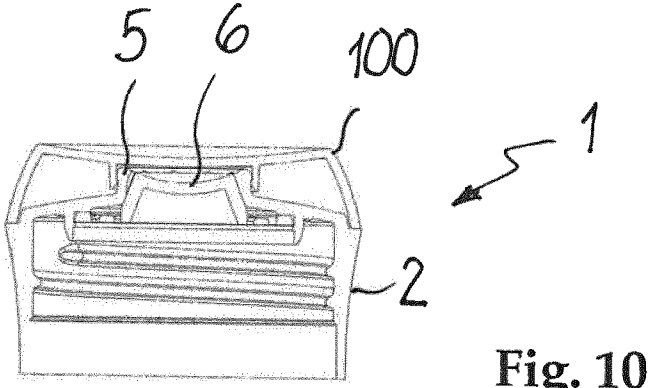
Fig. 9
Fig. 10
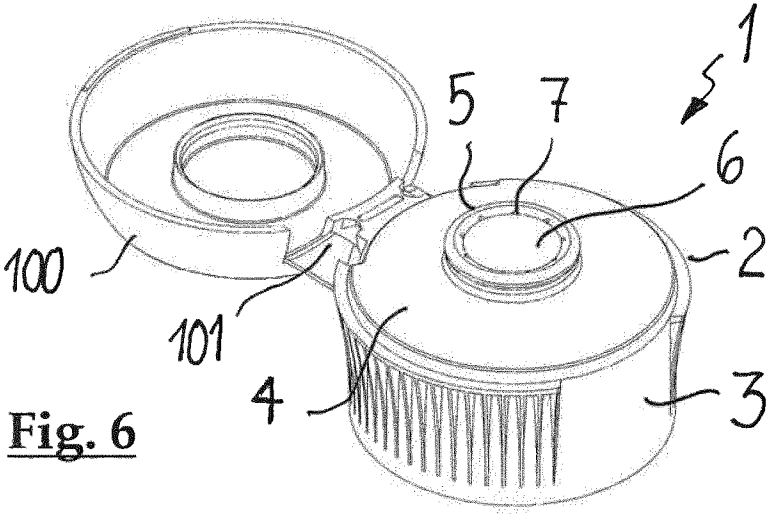
Fig. 6
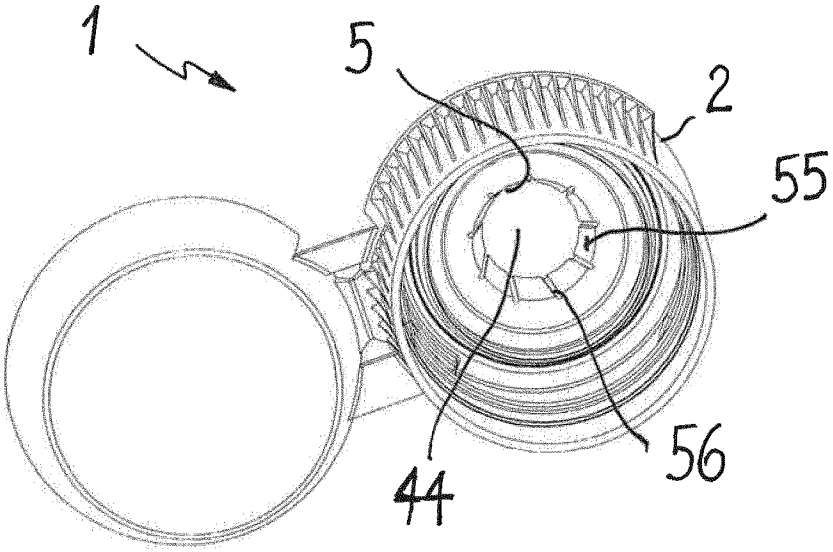
Fig. 7

SPRAY ATTACHMENT FOR BRINGING OUT FLUID SUBSTANCES IN A JET-LIKE MANNER

RELATED APPLICATION

This application claims priority as a continuation application under 35 U.S.C. § 120 to PCT/EP2019/057503, which was filed as an International Application on Mar. 26, 2019 designating the U.S., and which claims priority to Swiss Application 00617/18 filed in Europe on May 17, 2018. The entire contents of these applications are hereby incorporated by reference in their entireties.

FIELD

The present disclosure relates to a spray attachment for bringing out fluid substances in a jet-like manner.

In the household, in commerce and in industry, but also in pharmaceutical and cosmetic applications, it is very often necessary to spray fluid substances which are accommodated in a container, for example in a bottle or small bottle. "Fluid substances" according to the present disclosure are to be understood as liquids whose viscosity is small enough, in order to ensure an uninhibited continuous flow. For example, spray devices for liquids and creams which are brought out by a spray pump via a spray valve are known from the state of the art. A fanned-out bringing-out of the fluid substances is only possible to a limited extent with such spray valves. Furthermore, the spray valves tend to get blocked in the course of time, by which means the fanning out of the spray shot can yet be further compromised. Other known spray systems include a plastic container which can be squeezed together and on whose container neck an attachment which is provided with through-openings arranged in the manner of a sieve are arranged. The attachment can be a plastic injection part which is manufactured with multi-component technology. The through-openings are herein formed in a type of sieve plate which includes, for example, silicone. The attachment can yet also include a closure cap which is connected to the attachment via a tab which is injected on. By way of squeezing together the plastic container, the fluid substance which is stored in the container interior is sprayed through the through-openings which are designed and configured in a sieve-like manner.

Known spray systems can be complicated and expensive in design. The through-openings of the attachment parts which are designed and configured in a sieve-like manner are often quite different with regard to their diameter and therefore often do not permit a uniform spray jet with their use. The fanning-out of the spray jet is often effected only in a non-uniform manner.

SUMMARY

A spray attachment is disclosed for bringing out fluid substances in a jet-like manner, the spray attachment comprising: a cap with an annularly peripheral, closed skirt with a wall, on whose inner side or outer side first fastening means are integrally formed, said first fastening means being configured for engaging into corresponding second fastening means on an outer wall or inner wall of a container neck, and with a cover surface which closes off a longitudinal end of the skirt, which has a recess and which is configured for receiving an insert part, and a receiving part with a conical receiving surface which is closed in the circumferential direction is arranged in a region of the recess, said receiving part being configured for receiving a conical peripheral surface of the insert part which essentially corresponds with the conical receiving surface and is closed in the circumferential direction, wherein the conical receiving surface on the receiving part and the conical peripheral surface on the insert part delimit at least one through-channel for fluid substance when the conical receiving surface and the conical peripheral surface bear on one another, through which channel fluid substance can be brought out.

BRIEF DESCRIPTION OF THE DRAWINGS

Further advantages and features will be apparent from the subsequent description of exemplary embodiments of the invention with reference to the schematic drawings. In a schematic representation which is not true to scale, there are shown in various views:

FIG. 6 to FIG. 10 show a second exemplary embodiment;

In the schematic drawings of the different exemplary embodiments, the same elements and components of the spray attachment have the same reference numerals.

DETAILED DESCRIPTION

Figure 3:
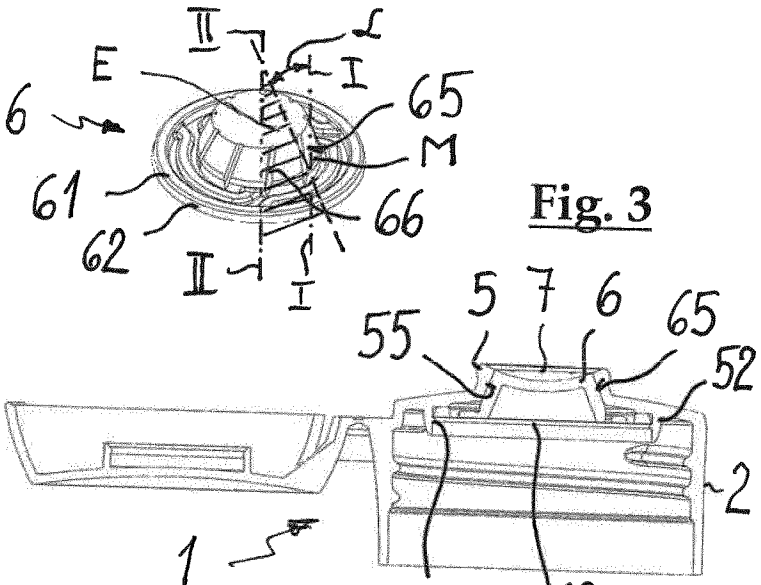
FIG. 1 to FIG. 5 show a first exemplary embodiment.

A spray attachment as disclosed is suitable for the application of fluid substances. The fluid substance should be able to be brought out of a container through the spray attachment in a jet-like manner by way of squeezing the container wall.

A spray attachment for bringing out fluid substances in the manner of a jet is disclosed herein with respect to various exemplary embodiments. An exemplary spray attachment can include a cap with an annularly peripheral, closed skirt with a wall, on whose inner side or outer side first fastening means are integrally formed. The first fastening means are designed and configured for engaging into corresponding second fastening means which can be provided on an outer wall or inner wall of a container neck. The skirt at a longitudinal end is closed off by a cover surface which can include a recess. A receiving part for receiving an insert part is arranged in a region of the recess. The receiving part can include a conical receiving surface which is closed in the circumferential direction. An essentially correspondingly conically designed and configured peripheral surface is formed on the insert part. The insert part can include an axial extension which is the same or smaller than an axial extension of the receiving part. The conical receiving surface of the receiving part and the conical peripheral surface of the insert part delimit at least one through-channel for the fluid substance, through which channel the fluid substance can be brought out when the conical receiving surface and the conical peripheral surface bear on one another.

By way of the at least one through-channel being delimited by the conical surfaces of the receiving part and of the insert part, the surfaces interacting with one another, significantly larger degrees of freedom exist for their design and manufacture when compared to sieve-like inserts of the state of the art. Hereby, the through-channel which is formed by the conical surfaces of the receiving part and of the insert part equates to a pipe with an entry opening and an exit opening. The at least one through-channel can also be manufactured with a significantly greater uniformity even in large-scale manufacturing methods, which can have an advantageous effect on the piece costs. Concerning the manufacturing process, it is to be noted that the insert part can be manufactured separately from the remaining closure with regard to location as well as time, so that these two parts after the completion of the injection moulding must be assembled into one another, as well as in a 2-component injection moulding method concerning which the complete spray attachment is already manufactured in one method step.

An exemplary design and configuration according to the present disclosure also permits the manufacture of at least one through-channel with smaller diameters without having to fall back on expensive manufacturing methods such as e.g. laser drilling. The receiving part can be provided for example with projections which on assembly of the insert part latch behind this and prevent a falling-out of the insert part by way of a positive fit. Hereby, the insert part which can be manufactured as a single part can be movable or fixed in the axial direction after the assembly into the receiving part which as a rule is formed as one piece on the cover surface of the skirt. Movable in the axial direction means that the insert part can be displaced relative to the receiving part from a first position, in which the conical receiving surface of the receiving part and the conical peripheral surface of the insert part bear on one another, into a second position, in which the conical receiving surface of the receiving part and the conical peripheral surface of the insert are distanced to one another, and vice versa. Herewith, a part-region of the at least one through-channel can be designed and configured in the form of a groove on the conical receiving surface of the receiving part and/or the conical peripheral surface of the insert part. As a rule, this part-region is designed and configured in a U-shaped or V-shaped manner. The at least one through-channel can therefore be formed by way of the conical receiving surface of the receiving part and the conical peripheral surface of the insert part bearing on one another.

Herewith, the through-channel can be formed by way of the groove on the conical receiving surface and on the conical peripheral surface being covered by a plane region of the conical peripheral surface and of the conical receiving surface respectively or by way of the groove on the conical receiving surface and the groove on the conical peripheral surface overlapping one another. Through-channels which can have a cross section down to about 0.005 $mm^2$ (e.g., ±10% or less or greater) can be formed, thereby forming a very fine jet. Such fine openings cannot be achieved with the injection moulding method, in contrast such small cross sections need to be drilled for example by way of a laser.

The cone of the conical peripheral surface of the insert part in the assembled state can be aligned in a manner such that its base surface faces the free end of the skirt, or given a spray attachment assembled on a container, by way of it facing the contents stored in the container. If the insert part is displaceable along its middle axis in the receiving part, then by way of squeezing the container the insert part can be displaced from the second position into the first position, so that the conical receiving surface of the receiving part and the conical peripheral surface of the insert part bear on one another and the at least one through-channel is formed by way of this. The squeezing can effect an elastically reversible deformation of the container wall of the container, which can be carried out several times without damaging the container. By way of squeezing the container wall, the pressure in the container can increase and the stored contents press onto the base surface of the conical peripheral surface of the insert part and displace the insert part into the first position before the stored fluid substance at least to some extent leaves the container in a jet which is formed by the at least one through-channel.

On account of the design as a conical receiving surface of the receiving part and conical peripheral surface of the insert part, an increase in the pressure in the inside of the container can also lead to an increase of the pressing pressure of the conical receiving surface onto the conical peripheral surface or vice versa. As a rule, the angles which the conical receiving surface encloses with the middle axis of the receiving part and the conical peripheral surface encloses with the middle axis of the insert part are equal, so that a surfaced bearing of the conical receiving surface and of the conical peripheral surface on one another is effected and not just a linear contact. The two angles are mostly designed and configured in a manner such that the conical peripheral surface and the conical receiving surface do not bear on one another in a self-locking manner. If by way of squeezing the container enough fluid substance is brought out of the container, then the bringing-out of the fluid substance can be interrupted by way of reducing the pressure upon the container to zero. Furthermore, by way of a restoring force of the container, this can assume its initial shape amid the generation of an underpressure (vacuum).

By way of generating the underpressure, the insert part can be displaced from the first position into the second position, so that the cross section through which the ambient air can get into the inside of the container can be enlarged compared to the cross section of the through-channel. By way of this, the container can return into its initial shape before the squeezing in a shorter time duration than if the ambient air were to have to get into the container inside solely through the cross section of the through-channel alone. Mostly, more than one through-channel is formed in a spray head. Basically, the fluid substance can be brought out of the spray attachment in a convergent, parallel and divergent manner by way of a suitable alignment of the conical receiving surface of the receiving part and of the conical peripheral surface of the insert part as well as by a suitable design of the grooves. Given the presence of more than one through-channel, the jets can meet essentially at one point or cross without contact given a divergent bringing-out.

In an exemplary embodiment, the at least one through-channel is formed by a groove which is formed on the conical receiving surface of the receiving part and/or on the conical peripheral surface of the insert part. From this, they result in the following three exemplary variants for forming the through-channels:

- groove/s on the conical receiving surface; conical peripheral surface smooth
- groove/s on the conical peripheral surface; conical receiving surface smooth
- groove/s on the conical receiving surface and groove/s on the conical peripheral surface.

Herein, the number of the grooves on the conical receiving surface can differ from the number of grooves on the peripheral surface. The groove/s on the conical receiving surface and the groove/s on the conical peripheral surface can be congruent, so that herewith the cross-sectional area of the groove/s on the conical peripheral surface and the cross-sectional area of the groove/s on the conical receiving surface sum. The conical receiving surface as well as the conical peripheral surface can also be arranged in a manner such that the respective groove/s does not overlap. Hence the total number of the through-channels can be increased very simply. The cross-sectional area of the groove/s as a rule is designed and configured in a U-shaped or V-shaped manner for reasons of manufacture, but however can for example have a shape without undercuts, so that no gate is necessary for mould removal from the injection mould.

An exemplary embodiment can envisage the at least one through-channel having a cross-sectional area of about 0.005 $mm^2$ to about 3.5 $mm^2$. The larger cross-sectional areas can herein be created for example by way of the conical receiving surface as well as the conical peripheral surface being provided with an equal number of grooves and the grooves being brought to overlap with one another.

In an exemplary embodiment of the spray attachment, the receiving part and the insert part have a circular cross section. The conical receiving surface and the conical peripheral surface can then be designed and configured for example as truncated cone surfaces.

An exemplary embodiment of the spray attachment can envisage the insert part having first positioning means which interact with second positioning means on the receiving part. By way of this, the insert part can be positioned in the receiving part in an exactly positioned manner on assembly.

Concerning an exemplary embodiment of the spray attachment, the insert part is arranged in a rotatable manner with respect to the conical receiving surface between for example, 0.5° and 179.5°, for example preferably between 0.5° and 90°, and for example particularly preferably between 5° and 60°. In this manner, if desired or necessary, the user has the possibility of changing the cross-sectional width of the through-channels by way of rotating the insert part with respect to the receiving part. This exemplary embodiment particularly lends itself given a spray attachment concerning which the conical receiving surface on the receiving part as well as the conical peripheral surface of the insert part is provided with grooves.

Cornering an exemplary embodiment of the spray attachment, the receiving part and the insert part are rotationally secured to one another. By way of this, it is ensured that in dependence on the application purpose, the grooves on the conical receiving surface of the receiving part and the grooves on the conical peripheral surface of the insert part either overlap one another or do not overlap. Hence it can be possible to cover two different application purposes without changing the parts. On the one hand one can create a spray attachment which brings out a lot of fluid substance with few but instead with thicker jets and on the other hand one which given the same pressure as a rule brings out less fluid with double the number of jets, but which instead are significantly thinner. The difference of the fluid expulsion given the same pressure can be due to the fact that despite the total equal cross-sectional area of the through-channels, the share of laminar flow is greater in the case of a spray attachment with more through-channels.

Concerning an exemplary embodiment variant of the spray attachment, the insert part is fixedly held in the receiving part along its middle axis. This embodiment variant in particular lends itself in the case of through-channels with a greater cross-sectional area since sufficient air can enter through these, in order to permit the container to return to its initial situation within a short time after the squeezing.

Concerning an alternative exemplary embodiment of the spray attachment, the insert part is displaceable in the receiving part along its middle axis between a first position and a second position, and vice versa. In the second position, in which the insert part for example lies on the projections of the receiving part, the conical peripheral surface of the insert part has a distance to the conical receiving surface of the receiving part. By way of this, an annular gap for the entry of air is formed between the two conical surfaces. If for a spray jet the fluid substance is pressed against the insert part, then this insert part is displaced in the direction of the conical receiving surface until the two conical surfaces bear on one another and hence delimit the through-channels. One can further envisage the insert part being biased into the second position by way of spring force. For this, resilient tabs can be arranged for example in the receiving part, said tabs protruding from a lower side of the cover surface of the cap and pressing upon a front surface of the insert part. The insert part can be displaceable in the receiving part along its axial extension by a predefined measure. The measure can lie in the range of for example, about 0.05 mm to about 5.0 mm, for example preferably in the range of 0.2 mm to about 3.00 mm.

The spray attachment can be designed and configured in different variants with regard to the fanning out of the spray jet. For example, concerning an exemplary embodiment variant of the spray attachment, the through-channels which are delimited by the grooves in the conical receiving surface of the receiving part and/or in the conical peripheral surface of the insert part have a divergent course in the spray direction. By way of this, the spray jet of the fluid substance is fanned out already on leaving the spray attachment.

According to an exemplary embodiment, each middle axis of at least two through-channels lies in a plane which is spanned by a generatrix of the conical receiving surface of the receiving part and a middle axis of the receiving part, or by a generatrix of the conical peripheral surface of the insert part and a middle axis of the insert part. Hereby, the through-channels or their middle axes can extend essentially along generatrices of the conical receiving surface of the receiving part or along generatrices of the conical peripheral surface of the insert part. The at least two jets are divergent or convergent, depending on the direction in which the conical peripheral surface enlarges or the conical receiving surface reduces. If the at least two jets are brought out of the spray head in a convergent manner, then they theoretically meet at a point which however actually represents a mixing region, in order to unify there into a common jet which subsequently essentially follows the middle axis of the spray attachment.

Surprisingly, it has been found that this one unified, common jet is swirled. This energy from the swirling can be used for example for foaming cleaning agents. This mixing region for the individually brought-out jets for the fluid substance can have a distance of for example, roughly 2 mm to about 1000 mm, for example preferably about 4 mm to about 30 mm to the insert part.

Furthermore, the through-channels can be designed and configured such that their middle axes in the respective plane enclose an angle to the respective generatrices. By way of this, the through-channels or the jets of the fluid substance which are brought out through the through-channels no longer follow the extension of the generatrix. By way of this, jets which despite the advantages which result from the interaction of the conical receiving surface of the receiving part and the conical peripheral surface of the insert part, follow essentially parallel to the middle axis of the receiving part or to the middle axis of the insert part. Herewith, finally the jets which are essentially parallel to the middle axis of the spray attachment can be brought out of the spray attachment.

According to an exemplary embodiment, each middle axis of at least two through channels intersects a plane at an angle. Hereby, the middle axes of the at least two through-channels extend essentially parallel to the conical receiving surface of the receiving part or essentially parallel to the conical peripheral surface of the insert part. Furthermore, the plane is spanned by a generatrix of the conical receiving surface of the receiving part and a middle axis of the receiving part or by a generatrix of the conical peripheral surface of the insert part and a middle axis of the insert part. Furthermore, the angle is greater than for example, 0° and smaller than 90°, for example preferably larger or equal to 5° and smaller or equal to 45°. The grooves extend in the form of a conical spiral on the conical receiving surface and/or the conical peripheral surface. Hereby, the grooves can be anticlockwise and/or clockwise. The angle at which the middle axis of the through-channel intersects the plane can also change along the through-channel. By way of this, a two-fold arcuate middle axis arises. The aforementioned angle details can, for example, relate to the opening mouth of the through-channel, through which mouth the jet leaves the spray attachment. By way of such a design of the through-channels, the jets which bring out the fluid substance can be directed in a convergent manner without contacting one another. As a rule, the through-channels extend essentially parallel to one another. Of course, it is also possible to vary the cross section of the grooves over their length, in regard to shape and/or their area content. In this manner, an adequate fanning of the spray jet is achieved even in the case of a convergent course of the through-channels.

According to an exemplary embodiment, the angles at which the middle axes of the through-channels intersect the plane are equal. Herewith, all through-channels are essentially parallel to one another.

Concerning an exemplary embodiment of the spray attachment, depending on the assembly method, the receiving part for the insert part or the insert part itself or both parts can axially project beyond an outer side of the cover surface of the cap or and form a pipe-stub-like continuation. The pipe-stub-like continuation can then serve for example for the sealing fixation of a closure.

Concerning an exemplary embodiment variant of the spray attachment, a hinge joint, for example a film hinge, which is connected to the cover part is integrally formed on the cap. A projecting closure cone which on closure sealingly interacts with the pipe-stub-like continuation on the cover surface of the cap is arranged on an inner surface of the cover part which faces the cover surface.

According to an exemplary embodiment, the spray attachment can be closed in a fluid-tight manner by way of a screw closure.

According to an exemplary embodiment, the spray attachment can be closed in a fluid-tight manner by way of a push-pull closure.

According to an exemplary embodiment, the spray attachment is for example, preferably manufactured in a plastic injection moulding method and/or a plastic compression moulding method. All plastics which are suitable for injection moulding can be applied.

An exemplary embodiment variant of the spray attachment envisages at least the cap with the skirt together with the cover surface and receiving part being manufactured from a plastic of the group including, e.g., consisting of, polyolefins, in particular polyethylene and polypropylene, HDPE, LDPE, their copolymers, recyclates of the mentioned polyolefins and mixtures of the mentioned polyolefins and of polyesters, in particular PET, PEF, PPF, PBT, their copolymers, recyclates of the mentioned polyesters and mixtures of the mentioned polyesters. The specified plastics have been tried and tested for the injection moulding methods for some time now and their chemical and physical parameters are known.

Concerning an exemplary embodiment variant of the spray attachment, the skirt together with the cover surface and the receiving part and the insert part can include (e.g., consist of) the same plastic. This embodiment variant of the spray attachment has the advantage of a particularly good dimensional accuracy since the cap, in particular the receiving part, and the insert part have the same shrinkage. Of course, the applied plastics can also be different from one another.

A plastic container with the spray attachment according to the present disclosure, according to one of the outlined variants, can include a container body which can be squeezed together in an elastically reversible manner at least in regions. A spraying of the fluid substance is effected by way of squeezing together the container body by hand. If the pressing force of the hand is relaxed, then air can enter into the inside of the container through the through-channels and/or through an annular gap between the conical surfaces of the receiving part and the attachment part, by which means the container body expands again further on account of its restoring force and assumes its original shape. The plastic container can herein be manufactured in a blow moulding method, for example in an extrusion blow moulding method or in a stretch blow moulding method.

Figure 4:
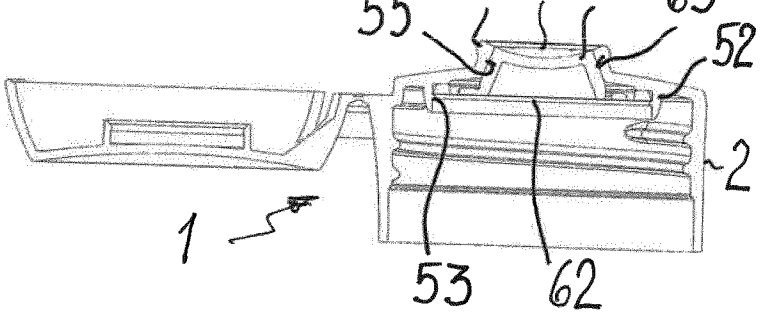
Figure 5:
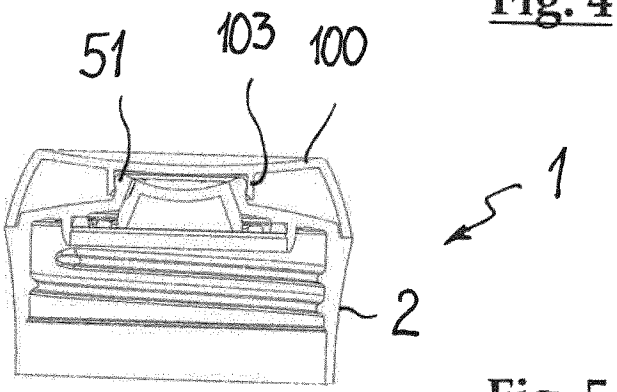
Figure 1:
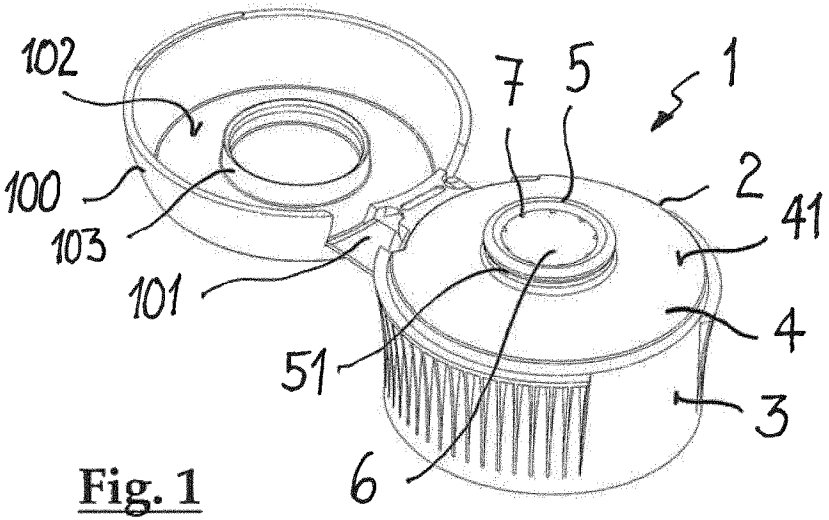

A first exemplary embodiment of a spray attachment and of the associated components is represented in the figures of FIG. 1 to FIG. 5. In the perspective view in FIG. 1, the spray attachment is provided in its entirety with the reference numeral 1. It includes a cap 2 with an essentially cylindrical skirt 3. A longitudinal end of the skirt 3 is closed by a cover surface 4. A closure part 100 is articulated on the skirt 3 of the spray attachment 1 via a hinge joint 101. The hinge joint 101 for example can be a bistable joint or a film hinge. The represented closure part 100 does not necessarily need to be connected to the skirt 3 of the cap 2 via a joint. In an alternative exemplary embodiment variant it can be designed and configured for example as a separate, removable part. A section of a receiving part 5 projects axially beyond an outer side 41 of the cover surface 4 and forms a pipe-stub-like continuation 51. The pipe-stub-like continuation 51 serves for the fixation of a sealing cone 103 which projects away from the inner wall 102 of the closure part (FIG. 5). By way of this, the cover part 100 can be fixed to the cap 2 with a non-positive or also positive fit. Furthermore, FIG. 1 shows that an insert part 6 is held in the receiving part 5. The receiving part 5 and the insert part 6 delimit the through-channels which are indicated by the reference numeral 7 and are hereinafter described in more detail.

Figure 2:
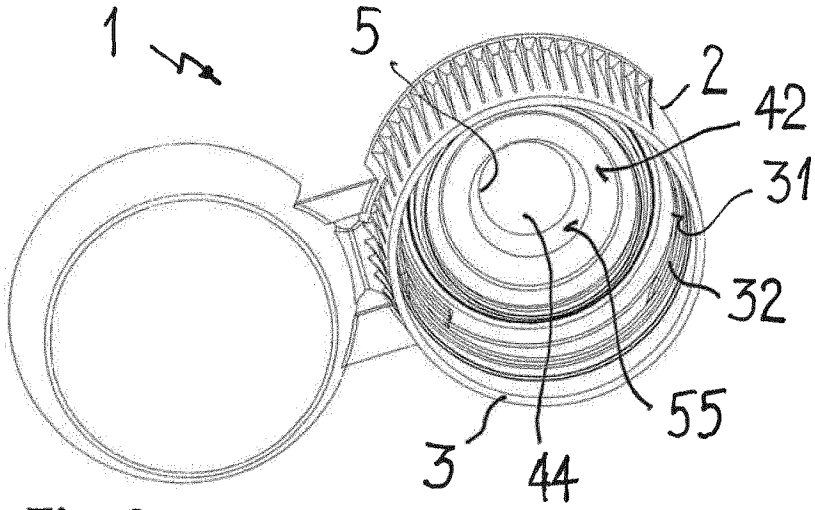

FIG. 2 shows a view from below into the cap 2 in the direction of an inner side 42 of the cover surface 4. The skirt 3 at its inner wall 31 includes first fastening means 32. For example, the first fastening means 32 are designed and configured as threaded sections as is indicated in FIG. 2. It is to be understood that the first fastening means 32 can also be designed and configured as thread turns, as projecting or receding elements of a bayonet closure and the like. The first fastening means 32 are designed and configured for engagement into second fastening means which are designed and configured corresponding to the first fastening means 32 and can be arranged on a container neck, for example on a bottle neck. In the embodiment which is represented in FIG. 2, the second fastening means are designed and configured as thread turns which are formed on the periphery of the container neck.

It is evident from FIG. 2 that the cover surface 4 is provided with a recess 44. The recess 44 is edged by a conical receiving surface 55 which is designed and configured closed in the circumferential direction and which forms the one constituent of the receiving part 5. The receiving part 5 receives the insert part 6. As is represented in FIG. 4, herein a conical peripheral surface 65 of the insert part 6 comes into bearing contact with the conical receiving surface 55 on the receiving part 5. The receiving surface 55 on the receiving part 5 and the peripheral surface 65 on the insert part 6 essentially have the same conicity. Herein, it is for example, preferably the case of truncated cone surfaces. The insert part 6 which is assembled in the receiving part 5 is held in the receiving part 5 for example in an axially immovable manner. For example, for this an annular continuation 52 which extends in the direction of the skirt 3 of the cap 2 and includes one or more inwardly facing projections 53 is formed on the receiving part 5. Given an insert part 6 assembled in the receiving part 5, the projections 53 engage into an annular groove 62 on a flange 61, as is evident in FIG. 3. Instead of an annular continuation 52, for example resilient tabs with inwardly facing projections can also be provided on the receiving part 5. The insert part 6 herein includes an axial extension which is equal to or smaller than an axial extension of the receiving part 5. In the case of an insert part 6 whose axial extension is smaller than that of the receiving part 5, the insert part 6 can also be held in the receiving part 5 in an axially movable manner. For example, for this, the receiving part 5 includes a continuation or tabs with inwardly directed projections which engage behind the flange 61 of the insert part 6. In the idle position, in which the insert part 6 lies for example on the projections of the receiving part 5, the conical peripheral surface 65 of the insert part 6 has a distance to the conical receiving surface 55 of the receiving part 5. By way of this, an annular gap for the entry of air is formed between the two conical surfaces 55, 65. If fluid substance is pressed against the insert part 6 for a spray jet, then this insert part is displaced in the direction of the conical receiving surface 55 until the two conical surfaces 55, 65 bear on one another and hence delimit the through-channels 7.

Furthermore, one can envisage the insert part 6 being biased into its idle position by way of a spring force. For this, for example resilient tabs can be arranged in the receiving part 5, the tabs projecting away from a lower side of the cover surface 4 of the cap 2 and pressing upon a front surface of the insert part 6. The axial movability of the insert part 6 can herein be for example about 0.05 mm to about 5.00 mm (e.g., +10% or less or greater), for example preferably about 0.2 mm to about 3.00 mm.

FIG. 3 shows a perspective view of the insert part 6. It includes a hat-like shape. The conical peripheral surface 65 of the insert part 6 is provided with grooves 66. In the assembled state of the insert part 6, the grooves 66 on interaction with the receiving part 5 form the already mentioned through-channels 7. In particular, the through-channels 7 are delimited when the conical peripheral surface 65 of the insert part 6 and the conical receiving surface 55 of the receiving part 5 bear on one another. Positioning elements which interact with corresponding receivers on the receiving part 5 can be formed on the flange 51 of the insert part 61. By way of this, the position of the insert part 6 in the receiving part 5 can be fixed in the circumferential direction. Furthermore, it can be seen that the grooves 66 extend parallel to one another. Furthermore, the grooves 66 extend on the conical peripheral surface 65 of the insert part 6. It is also evident that each middle axis I-I of the grooves 66 intersects a plane E at an angle $\alpha$ which in the present exemplary embodiment is about 15°, wherein the plane E is spanned by a generatrix M of the conical peripheral surface 65 of the insert part 6 and a middle axis I-I of the insert part 6. The grooves 66 can have any shape in cross section, and in the exemplary embodiment are designed and configured in a U-shaped manner.

The second exemplary embodiment of the spray attachment which is shown in the drawings of the FIG. 6 to FIG. 10 basically has the same construction as the first exemplary embodiment according to FIG. 1 to FIG. 5. In contrast to the first exemplary embodiment however, the conical peripheral surface 65 of the insert part 6 is not structured which is to say is designed and configured in a smooth manner (FIG. 8). However, instead grooves 56 are formed in the conical receiving surface 55 (FIG. 7). Given an assembled insert part 6, the grooves 56 in the conical receiving surface 55 of the receiving part 5 on interaction with the insert part 6 form the through-channels 7 which in turn are delimited by the conical receiving surface 55 on the receiving part 5 and the conical peripheral surface 65 on the insert part 6.

Figure 11:
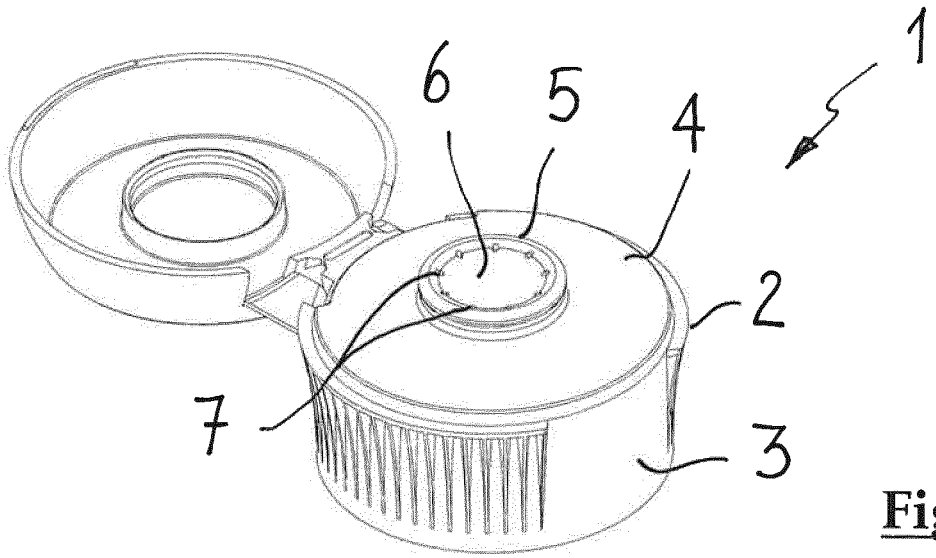
FIG. 11 to FIG. 13 show a third exemplary embodiment.
Figure 12:
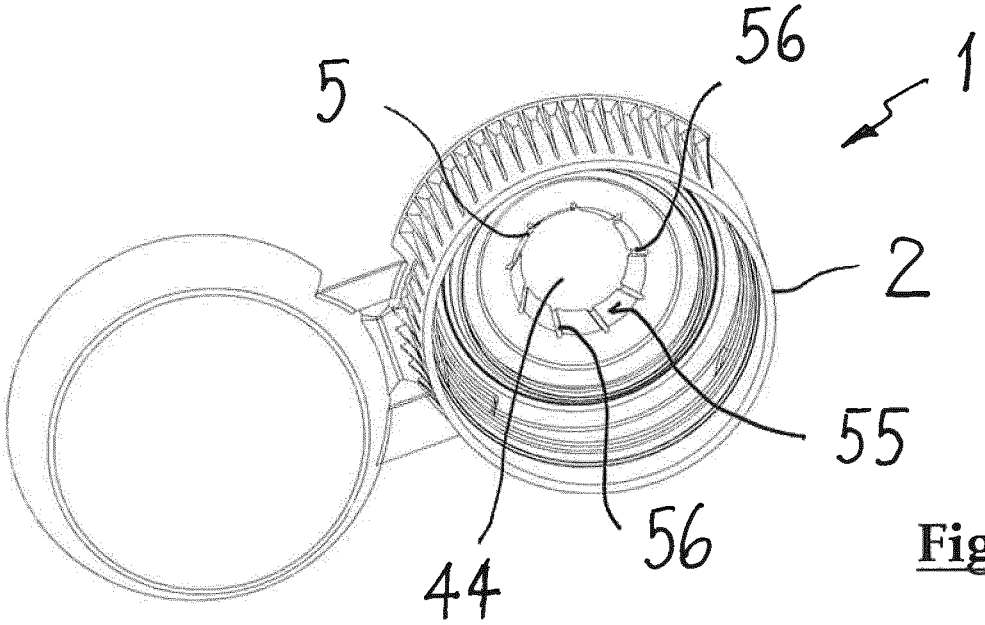
Figure 13:
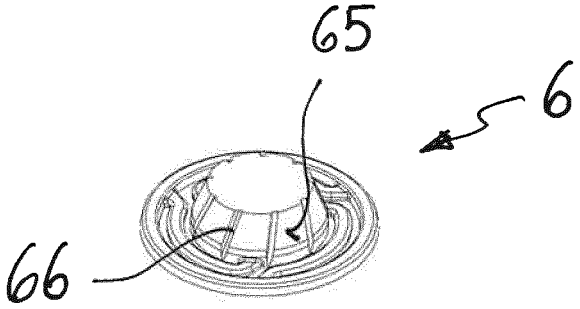

The third exemplary embodiment of the spray attachment 1 which is represented in FIG. 11 to FIG. 13 represents a combination of the first and second exemplary embodiments. In particular, FIG. 12 and FIG. 13 show that the conical receiving surface 55 of the receiving part 5 and the conical peripheral surface 65 of the insert part 6 are provided with grooves 56 and 66 respectively. FIG. 11 shows the conditions given an assembled insert part 6 when the grooves 56, 66 have been brought to overlap with one another. The cross sections of the grooves 56 in the conical receiving surface 55 and the grooves 66 in the conical peripheral surface 65 then add. In an alternative exemplary embodiment variant of the spray attachment which is not represented, the grooves can also not be brought to overlap. The numbers of the grooves in the conical receiving surface and of the grooves in the conical peripheral surface then sum. Herein, the numbers of the grooves in the peripheral surface and in the receiving surface can be different from one another. One can also envisage the user rotating the insert part with respect to the receiving part to a certain extent if required, depending on whether a greater cross section of the through-channels or a greater number of through-channels is of interest to him.

Figure 16:
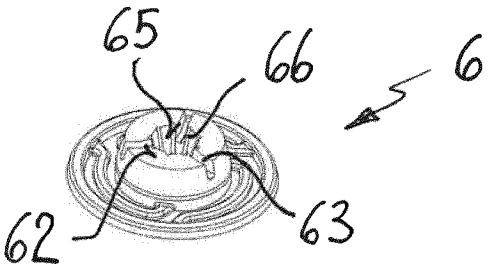
FIG. 14 to FIG. 18 show a fourth exemplary embodiment.
Figure 17:
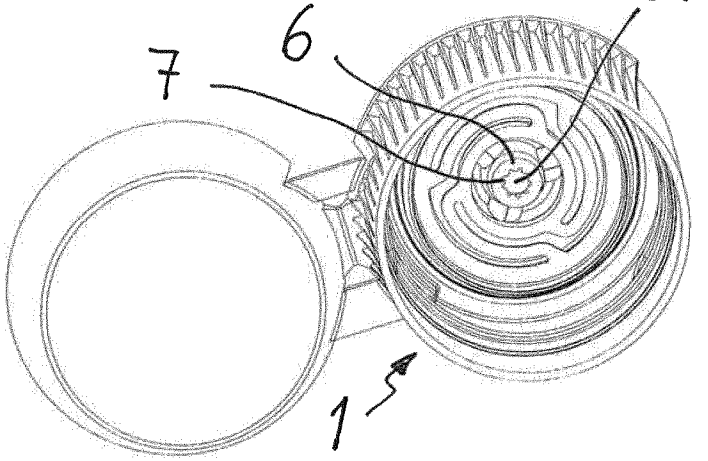
Figure 18:
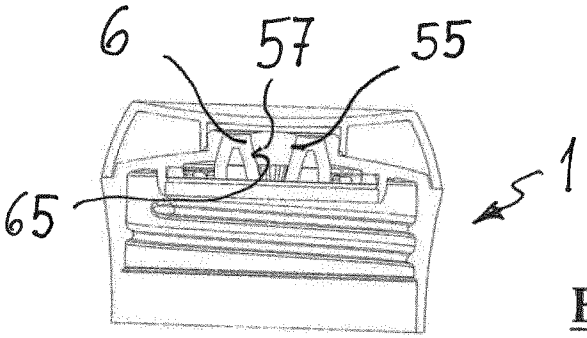
Figure 14:
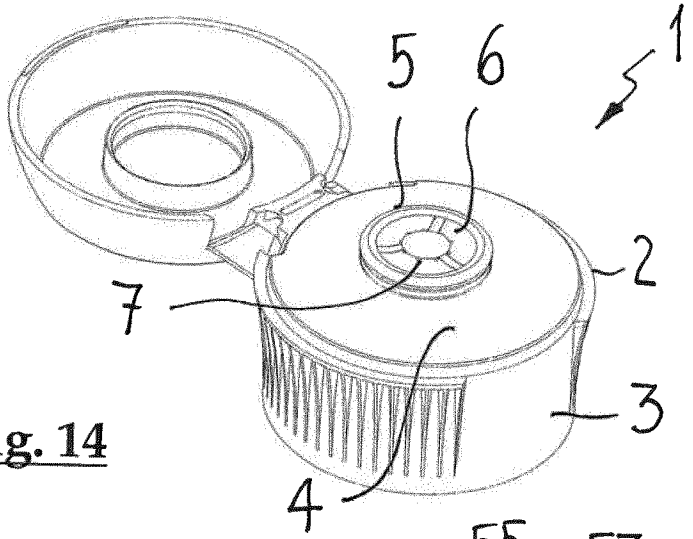
Figure 15:
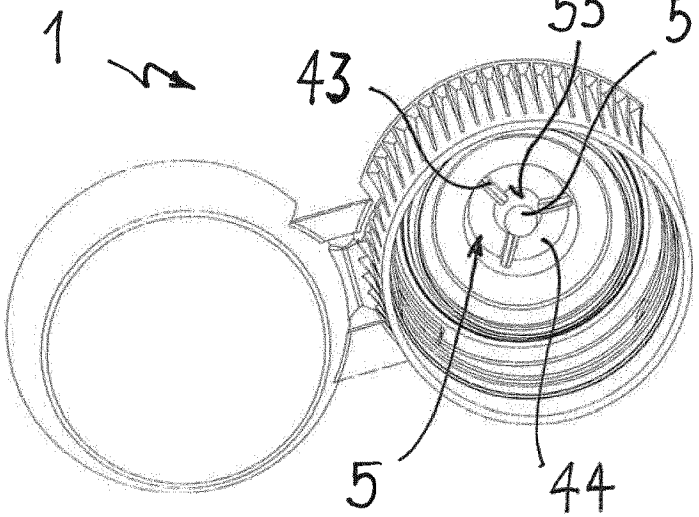

Concerning the fourth exemplary embodiment of the spray attachment 1 which is represented in the drawings of FIG. 14 to FIG. 18, in particular FIG. 15 shows that the receiving part 5 includes a cone 57 which tapers in the direction of the free end of the skirt 3. The cone 57 is held by webs 43 which roughly radially bridge the recess 44 in the cover surface 4. The cone 57 is for example, arranged roughly centrally of the recess 44. The cone 57 includes an outer surface which with this exemplary embodiment forms the conical receiving surface 55. The insert part 6 which is represented in FIG. 16 is designed and configured in a slightly modified manner with respect to the insert parts which are outlined by way of the first three exemplary embodiments. For example, the modified insert part 6 includes an inner peripheral surface which again is denoted as a peripheral surface 65 of the insert part 6. Radial recesses 63 are arranged on an upper side 62 of the section of the insert part 6 which extends from the flange 61, the recesses receiving the radial webs 43 on the recess 44 given an assembled insert part 6. These recesses 63 in combination with the radial webs 43 can also represent positioning means which prevent a rotation also of an insert part 6 which is displaceable along its middle axis. The peripheral surface 65 of the insert part 6 which is designed and configured as an inner peripheral surface includes grooves 66 which, given an assembled insert part 6, in combination with the receiving part 5 form the through-channels 7. Herein, the through-channels 7 are again delimited by the conical receiving surface 55 on the cone 57 and by the corresponding conical peripheral surface 65 on the inner periphery of the insert part 6. Whereas the peripheral surface 65 of the insert part 6 is provided with grooves 66 in the represented exemplary embodiment, it is to be understood that analogously to the embodiment variants which are outlined by way of the exemplary embodiments 1 to 3, the grooves can also alternatively or also additionally be arranged on the receiving surface 55 of the cone 57. The same applies to the rotatability of the insert part 6 with respect to the receiving part 5.

Figure 19:
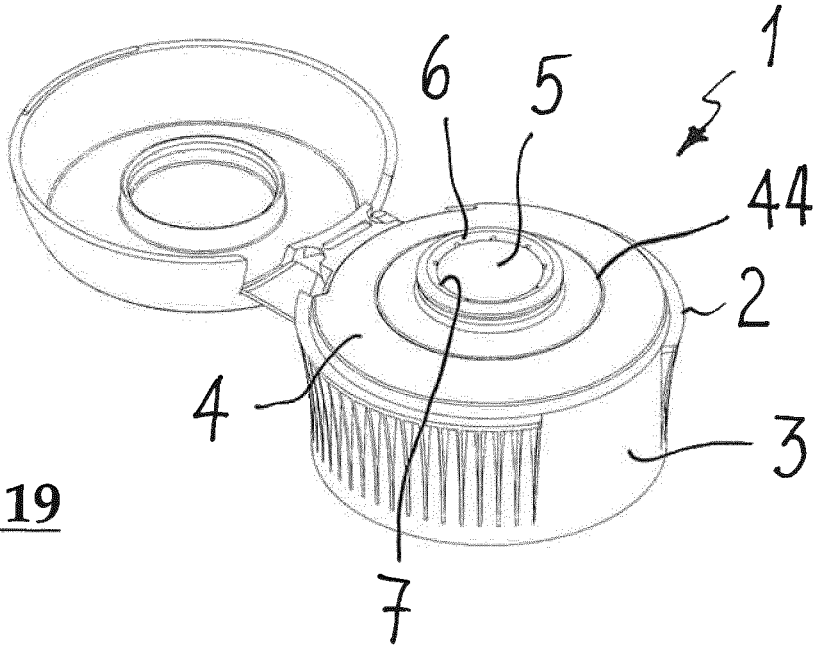
FIG. 19 to FIG. 21 show a fifth exemplary embodiment.
Figure 20:
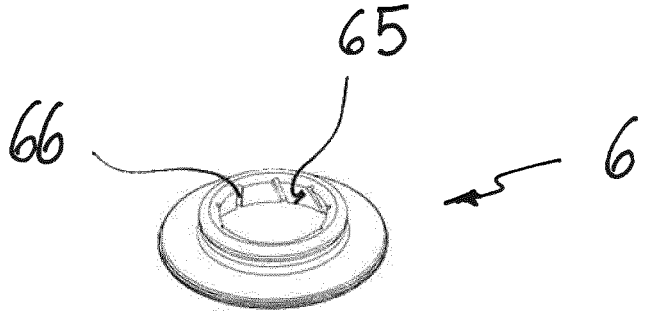
Figure 21:
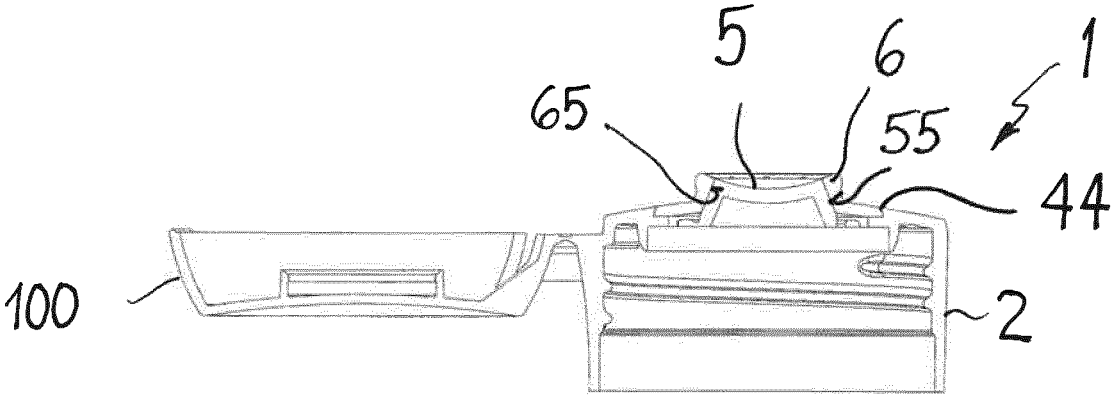

A fifth exemplary embodiment of the spray attachment which again has the reference numeral 1 is represented in the drawings of FIG. 19 to FIG. 21. In contrast to the exemplary embodiments which are outlined above, concerning this variant of the spray attachment 1, the insert part 6 cannot be assembled in the receiving part 5 through the skirt 3 of the cap 2, but it is placed onto the receiving part 5 from the outside, the receiving part being arranged in the region of the recess 44 in the cover surface 4. As is evident in FIG. 21, the receiving part 5 again includes a conical receiving surface 55. As is shown in FIG. 20, the insert part 6 has a conical peripheral surface 65 which is designed and configured as an inner peripheral surface. The conical peripheral surface 65 of the insert part is provided with grooves 66. Together with the conical receiving surface 55 of the receiving part 55, the grooves 66 form the through-channels 7 for a fluid substance. Again the grooves can be arranged on the conical receiving surface 55 of the receiving part 5 instead of on the conical peripheral surface 65 of the insert part 6 or on both conical surfaces. By way of this, again the possibility is given of creating through-channels 7 with greater cross sections when the conical peripheral surface 65 and the conical receiving surface 55 bear on one another, or of increasing the number of through-channels 7. Herein, one can even envisage the user, as is required, either being able to select the one variant with larger cross sections of the through-channels 7 or the other variant with a larger number of through-channels 7.

Common to all outlined embodiment variants of the spray attachment 1 is that the through-channels which are delimited by the conical receiving surface 55 and the conical peripheral surface 65 have a cross section in the region of between for example, 0.05 $mm^2$ and about 3.5 $mm^2$.

As is evident from the drawings in FIG. 3, FIG. 7, FIG. 12, FIG. 13 and FIG. 20, the grooves 56, 66 in the conical peripheral surfaces 65 or receiving surfaces 55 are arranged in an inclined manner with respect to the axial extension of the cap 2. Concerning these embodiment variants, the through-channels 7 which are delimited by the conical receiving surface 55 of the receiving part 5 and by the conical peripheral surface 65 of the insert part 6 have a convergent course in the spray direction. This means that the individual jets of the fluid substance which is brought out are firstly directed onto one another before the spray jet is fanned out. The inclined course of the grooves 56, 66 serves for the individual jets of the fluid substance which are brought out not contacting one another. In this manner, an adequate fanning out of the spray jet is achieved even with a convergent course of the through-channels 7.

Concerning an alternative variant of the spray attachment with through-channels, which extend along the generatrices it, these however can be aligned to one another such that the individual spray jets in the spray direction form a focus-like mixing region which is situated outside the spray attachment by way of the spray jets essentially unifying into a spray jet. This embodiment variant can be of interest for example given substances which must yet foam after being brought out. The focus-like mixing region can herein have a distance to the insert part 6 of for example, about 2 mm to about 1000 mm, for example preferably for about 4 mm to about 30 mm.

The grooves in the (inner) peripheral surface 65 of the insert part according to FIG. 16 have a divergent course in the spray direction. By way of this, the spray jet of the fluid substance moves away from the middle axis of the insert part already on leaving the spray attachment 1. A mutual contacting of the individual jets is ruled out.

The spray attachment according to exemplary embodiments is designed and configured for the spraying of fluid substances. "Fluid substances" in the context of the present disclosure are to be understood as liquids whose viscosity is small enough in order to ensure an uninhibited continuous flowing. The spray attachment is for example manufactured in a plastic injection moulding method and/or plastic compression moulding method. All plastics which are suitable for injection moulding and/or plastic compression moulding can be applied as plastic. Herein, at least the cap with the skirt together with the cover surface and receiving part can be manufactured as one piece from a plastic from the group including (e.g, consisting of) polyolefins, in particular polyethylene and polypropylene, HDPE, LDPE, their copolymers, recyclates of the mentioned polyolefins and mixtures of the mentioned polyolefins and of polyesters, in particular PET, PEF, PPF, PBT, their copolymers, recyclates of the mentioned polyesters and mixtures of the mentioned polyesters. The specified plastics have been tried and tested for the injection moulding methods and/or plastic compression moulding methods and their chemical and physical parameters are known.

Concerning a further exemplary embodiment variant of the spray attachment, the skirt together with the cover surface and the receiving part and the insert part can include (e.g., consist of) the same plastic. This embodiment variant of the spray attachment has an advantage of a particularly good dimensional accuracy since the cap, in particular the receiving part, and the insert part have the same shrinkage.

A plastic container with a spray attachment 1 according to the outlined exemplary embodiment variants can include a container body which at least in regions can be squeezed together in an elastically reversible manner. A spraying of the fluid substance is effected by way of squeezing together the container body by hand. Hereby, on account of the pressure within the container body, increased with respect to the atmosphere, the displaceable insert part 6 is displaced from a second opened position into the first closed position, so that the conical peripheral surface 65 of the insert part 6 and the conical receiving surface 55 of the receiving part 5 bear on one another. Hereby, the fluid substance is brought out of the container body through the through-channels 7 which are formed by the bearing of the conical surfaces 55, 56 on one another. If the pressing force of the hand relaxes, then an underpressure in the container body with respect to the atmosphere which surrounds the container forms on account of the tendency of the container body to return into its original shape due to its stiffness. By way of this, air can flow through the through-channels 7 into the inside of the container, by which means the container body expands again and assumes its original shape. Given a displaceable insert part 6, on account of the underpressure present in the container body this insert part can be retracted from the first position into the second position, so that an annular gap forms between the conical surfaces 55, 65 of the receiving part 5 and of the insert part 6, through which gap the air can get into the container body and hence the restoring of the container body can be carried out more rapidly. It is to be noted that the displacing of the insert part from the first position into the second position can also be effected in a spring-assisted manner. The plastic container can herein be manufactured in a blow moulding procedure, for example in an extrusion blow moulding method or in a stretch blow moulding method.

The invention has been explained by way of specific exemplary embodiments which have been represented in the drawings. The aforementioned description of the specific exemplary embodiments merely serves for the explanation of the invention and is not to be considered as limiting. The invention is defined by the patent claims and the equivalents which are derived by the person skilled in the art and encompassed by the general inventive concept.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. A spray attachment for bringing out fluid substances in a jet-like manner, the spray attachment comprising:

a cap with an annularly peripheral, closed skirt with a wall, on whose inner side or outer side first fastening means are integrally formed, said first fastening means being configured for engaging into corresponding second fastening means on an outer wall or inner wall of a container neck, and with a cover surface which closes off a longitudinal end of the skirt, which has a recess and which is configured for receiving an insert part; and a receiving part with a conical receiving surface which is closed in a circumferential direction is arranged in a region of the recess, said receiving part being configured for receiving a conical peripheral surface of the insert part which essentially corresponds with the conical receiving surface and is closed in the circumferential direction, wherein the conical receiving surface on the receiving part and the conical peripheral surface on the insert part delimit at least one through-channel for fluid substance when the conical receiving surface and the conical peripheral surface bear on one another, through which the at least one through-channel fluid substance can be brought out.

2. A spray attachment according to claim 1, wherein the at least one through-channel is formed by a groove which is formed on the conical receiving surface of the receiving part and/or on the conical peripheral surface of the insert part.

3. A spray attachment according to claim 1, wherein the at least one through-channel has a cross-sectional area of about 0.005 $mm^2$ to about 3.5 $mm^2$.

4. A spray attachment according to claim 1, wherein the insert part comprises:

first positioning means which interact with second positioning means on the receiving part.

5. A spray attachment according to claim 1, wherein the insert part is configured to be arranged in a rotatable manner with respect to the conical receiving surface, between 0.5° and 179.5°.

6. A spray attachment according to claim 1, wherein the receiving part and the insert part are rotationally fixed to one another.

7. A spray attachment according to claim 1, wherein the insert part along its middle axis is fixedly held in the receiving part.

8. A spray attachment according to claim 1, wherein the insert part is configured to be displaceable in the receiving part along its middle axis between a first position and a second position, and vice versa.

9. A spray attachment according to claim 8, wherein the insert part, is configured to be displaceable in the receiving part along its middle axis by a predefined measure which lies in a range of about 0.05 mm to about 5.0 mm.

10. A spray attachment according to claim 1, wherein each middle axis of at least two through-channels lies in a plane which is spanned by a generatrix of the conical receiving surface of the receiving part and a middle axis of the receiving part, or by a generatrix of the conical peripheral surface of the insert part and a middle axis of the insert part.

11. A spray attachment according to claim 1, wherein each middle axis of at least two through channels intersects a plane at an angle, wherein the middle axes of the at least two through-channels extend essentially parallel to the conical receiving surface of the receiving part or essentially parallel to the conical peripheral surface of the insert part, wherein the plane is spanned by a generatrix of the conical receiving surface of the receiving part and a middle axis of the receiving part or by a generatrix of the conical peripheral surface of the insert part and a middle axis of the insert part, wherein the angle is greater than 0° and smaller than 90°.

12. A spray attachment according to claim 11, wherein the angles at which the middle axes of the through-channels intersect the plane are equal.

13. A spray attachment according to claim 11, wherein generatrices of the conical receiving surface of the receiving part or generatrices of the conical peripheral surface of the insert part meet essentially at one point, wherein the point is located counter to the extension direction of the skirt from the cover surface.

14. A spray attachment according to claim 1, wherein generatrices of the conical receiving surface of the receiving part or generatrices of the conical peripheral surface of the insert part meet essentially at one point, wherein the point is located in an extension direction of the skirt from the cover surface.

15. A spray attachment according to claim 1, wherein the insert part is configured essentially as a truncated cone.

16. A spray attachment according to claim 1, wherein the receiving part and/or the insert part project axially beyond an outer side of the cover surface of the cap and form a pipe-stub-like continuation.

17. A spray attachment according to claim 16, comprising:

a hinge joint connected to the cover part and integrally formed on the cap, said cover part on an inner surface which faces the cover surface having a closure cone which projects away therefrom and sealingly interacts with the pipe-stub-like continuation.

18. A spray attachment according to claim 1, configured as a plastic injection and/or a plastic compression molded attachment.

19. A spray attachment according to claim 1, wherein at least the skirt together with the cover surface and receiving part are integrally configured as one piece of a plastic of the group consisting of polyolefins, polyethylene and polypropylene, HDPE, LDPE, their copolymers, recyclates of the mentioned polyolefins and mixtures of the mentioned polyolefins and of polyesters, PET, PEI, PPF', PBT, their copolymers, recyclates of the mentioned polyesters and mixtures of the mentioned polyesters.

20. A spray attachment according to claim 1, wherein the skirt together with the cover surface and the receiving part and the insert part consist of a same plastic.

21. A plastic container in a combination with the spray attachment according to claim 1, wherein the plastic container comprises:

a container body which can be squeezed together in an elastically reversible manner at least in regions.

22. A plastic container according to claim 21, configured as a blow molded container.

* * * * *